United States Patent [19]

Coaton et al.

[11] 4,256,988

[45] Mar. 17, 1981

[54] INCANDESCENT HALOGEN LAMP WITH PROTECTIVE ENVELOPE COATING

[75] Inventors: James R. Coaton; John M. Rees, both of London; Roger N. Rothon, Runcorn, all of England

[73] Assignees: Thorn Lighting Limited; Imperial Chemical Industries Limited, both of London, England

[21] Appl. No.: 973,441

[22] Filed: Dec. 26, 1978

Related U.S. Application Data

[63] Continuation of Ser. No. 758,872, Jan. 17, 1977, abandoned.

[51] Int. Cl.[3] ..... H01K 1/32; H01K 1/50

[52] U.S. Cl. ..... 313/221; 313/222

[58] Field of Search ..... 313/222, 221

[56] References Cited

U.S. PATENT DOCUMENTS

| | | | |
|---|---|---|---|
| 1,925,857 | 9/1933 | Van Liempt | 313/222 X |
| 2,104,073 | 1/1938 | Druyvesteyn et al. | 313/221 |
| 3,022,438 | 2/1962 | Cooper, Jr. | 313/222 |
| 3,311,777 | 3/1967 | Schröder | 313/222 X |
| 3,350,598 | 10/1967 | Corbin et al. | 313/221 X |
| 3,496,401 | 2/1970 | Dumbaugh, Jr. | 313/222 X |
| 3,845,343 | 10/1974 | Hammer | 313/221 |
| 3,900,754 | 8/1975 | Mason et al. | 313/221 |
| 3,902,091 | 8/1975 | Mason et al. | 313/222 X |

*Primary Examiner*—Palmer C. Demeo

*Attorney, Agent, or Firm*—Robert F. O'Connell

[57] ABSTRACT

The invention relates to electric incandescent lamps having a gas fill containing halogen. The internal surface of the lamp envelope and optionally also the exposed surface of internal components of the lamp are protected from attack by halogens including fluorine by a continuous imperforate coating composed of a metal oxide resistant to halogen attack. In order to achieve the necessary degree of continuity of the coating the oxide is formed in situ from a compound of the metal deposited as a solution on the surface. The preferred oxide is alumina, the other oxides of polyvalent and transition metals, including metals of the lanthanide series may be used. The coatings are preferably formed from solutions of halides of the metals in polar organic solvents such as methanol. The invention prolongs the life of lamps provided with the protective coating and enable such resistant and possibly cheaper materials to be employed for certain lamp components.

3 Claims, 1 Drawing Figure

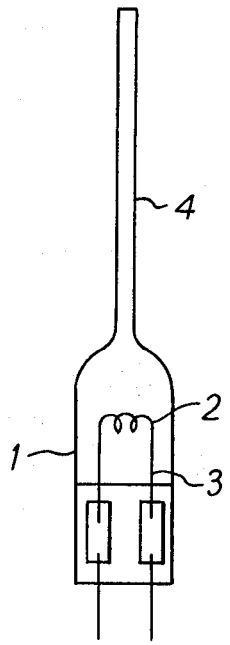
4
2
1
3

INCANDESCENT HALOGEN LAMP WITH PROTECTIVE ENVELOPE COATING

This is a continuation of application Ser. No. 758,872, filed Jan. 17, 1977, and now abandoned.

This invention relates to electric incandescent lamps, and more especially to incandescent lamps operating by a halogen cycle.

In any incandescent tungsten filament lamp containing a reactive fill such as halogen or halide, the choice of material for the internal components and envelop is usually very restricted. For lamps having iodine, bromine or chlorine in the fill the envelope is preferably fused quartz or a high silica content glass and the lead-in wire, filament supports, internal reflectors, shields and other internal components are substantially composed of molybdenum or tungsten. If less expensive, common materials such as nickel, iron, copper, aluminium and alloys containing these are used they react with the halogens to form halides which can cause filament embrittlement, and/or a halogen deficiency, both resulting in severely reduced filament life. Also, if soft glass, such as soda lime silicate, is used for the envelope, apart from the obvious difficulties of the low softening temperature and high water content, the alkali metals can react with the halogen or halides, again reducing filament life.

In operation, tungsten-halogen lamps normally contain a non-reactive gas filling such as $N_2$, Ar, Kr or Xe together with iodine, bromine or chlorine vapour which combines with the evaporated tungsten escaping from the incandescent filament. An equilibrium concentration is attained by the gaseous species within the lamp between the temperature limits defined by the incandescent filament and coldest spot on the lamp envelope. The cold spot temperature must be sufficiently high to prevent any tungsten halide from condensing, and provided that this condition is met a continuous tungsten transport cycle operates which keeps the envelope free from tungsten. The minimum envelope temperature depends upon the halogen or halogens taking part in the cycle. However, the maximum envelope temperature is usually well above the acceptable limit for soft glass, and for this reason tungsten-halogen lamp envelopes are usually made from vitreous fused silica or high silica content glasses.

The return of tungsten to the filament does not in itself increase filament life since tungsten iodides, bromides and chlorides dissociate well below normal filament operating temperatures. Radio-chemical tracers have shown that evaporated tungsten is redistributed during the life of the lamp so that the cooler parts of the filament collect tungsten at a greater rate than the hotter parts. Filament failure usually occurs quite normally by the subsequent burn-out of a 'hot spot'. The improvement in life of tungsten-halogen lamps in comparison with conventional incandescent lamps is for quite a different reason. The absence of envelope blackening coupled with the requirement for a well-defined minimum envelope temperature dictates that the envelope must be substantially smaller than that of a conventional counterpart. In fact, tungsten-halogen lamp envelopes are usually small and mechanically strong and in consequence can be safely gas-filled to several atmospheres pressure. This increased gas filling pressure accounts for the gain in life.

If filament 'hot spots' could be healed or prevented a further extension in filament life would be possible. This is feasible with a tungsten-fluorine transport cycle because in this case the most stable tungsten fluoride dissociates at a temperature above 3000° C., and tungsten is returned to the incandescent filament surface. Again, this has been substantiated by radiochemical tracer experiments, which show that tungsten vapour returned from the region of the envelope is evenly distributed along the incandescent part of the filament. Technological difficulties have prevented the further development of tungsten-fluorine lamps, the principal problem being that free fluorine reacts rapidly with solid tungsten below about 2000° C., the cold parts of the filament, the lead wires and the supports being rapidly eroded, and that the fluorides formed (e.g. tungsten fluorides) react with the silica contained in the envelope material to form $SiF_4$, depositing tungsten on the tube wall. This uses up the free fluorine in a very short time. Various methods have been proposed for protecting the envelope and tungsten components but these have been unsuccessful because of the inability to produce a continuous thin layer of protective material free from pinholes and minor defects.

In our Pat. Nos. 3,900,754 3,902,091 and 3,982,046 we describe the use of glassy coatings of metal phosphates or arsenates as protective coatings for the internal surfaces of halogen-containing electric lamps, and describe a process for the formation of defect-free coatings by deposition of a solution of compounds of the metal and phosphorus or arsenic, followed by evaporation of the solvent and baking of the resulting layer.

U.S. Pat. No. 3,067,356 describes a fluorescent lamp having an internal barrier layer of, inter alia, aluminium oxide intended to reduce darkening of the lamp by reaction of mercury in the gas fill with alkali in the glass of the lamp tube. Not only is the use of this coating different from that required for this invention, but the layer in the Patent referred to is formed by applying the particulate oxide in a lacquer vehicle, followed by drying and baking, and such a layer does not provide effective protection against a highly reactive gas such as fluorine.

The present invention now provides an alternative or improved protective layer for the exposed internal surfaces of incandescent lamps which tend to react with the fill in the lamp envelope, particularly where this includes a halogen, and more especially fluorine or a fluorine-containing compound.

In accordance with this invention at least those portions of the internal surface of the envelope of a halogen cycle incandescent lamp, and preferably also the exposed surfaces of internal components which tend to react with the fill in the envelope during operation of the lamp are coated with a continuous imperforate covering substantially consisting of a metal oxide resistant to halogen attack and derived from a compound of the said metal deposited on such surfaces from solution.

Further in accordance with this invention there is provided a method of making a halogen cycle incandescent lamp which comprises coating at least those portions of the internal surface of the envelope and the exposed surfaces of internal components which tend to react with halogen during operation of the lamp with a solution of a metal compound capable of generating on being heated a halogen-resistant oxide of the metal, and heating the resulting coating to form on the surface a coating of the said oxide.

The preferred metal oxide for the formation of the coating is aluminium oxide, but other halogen-resistant oxides, more especially of polyvalent or transition metals such as cerium, thorium and yttrium, and others of the lathanide series, may be used. Aluminium oxide has an especial advantage in that coatings formed thereby are both colourless and transparent. The coatings are preferably formed from solutions of halides of the metals in polar organic solvents such as methanol.

Preferred solvents for the preparation of the coating solution are oxygen-containing organic solvents such as alcohols, esters, ketones, aldehydes, nitro-compounds and ethers, or mixtures thereof. Particularly preferred are aliphatic alcohols, especially lower molecular weight alcohols containing 1 to 4 carbon atoms, for example methanol, ethanol, n- or iso-propanol or substituted alcohols such as methoxy- or ethoxy-ethanol. A wide variety of compounds of the metals can be used, provided they are soluble in the chosen solvent and generate on being heated the desired oxide without substantial contamination by other elements. Simple inorganic salts of the metals are preferred, especially the halides, but organic salts such as acetates may also be used. The salt may form in solution a complex with molecules of the solvent.

The coated surfaces in the lamps of this invention may include the internal surface of the envelope, the filament tails or lead-in wires or the filament supports, depending on the nature of the fill gas employed and on the materials from which the envelope and the internal components are fabricated. Part or all of the filament or filaments may be initially provided with a coating, for example where the coating technique according to the invention cannot conveniently avoid this, but the coating on the filament will be removed when the filament is heated to incandescence.

The protective coatings provided in accordance with this invention may be applied to conventional materials used for the fabrication of lamp components, for example to protect them from highly reactive fill substances, or they may enable cheaper and more readily available materials to be substituted for conventionally used materials without unacceptable loss in performance or life.

The oxide coating should be continuous and free from pin-holes or other defect or imperfection which might cause it to break down during operation of the lamp. Suitable coatings are glass-like in appearance but may have a microcrystalline structure. They preferably have a thickness in the range 0.001–1 microns. Alternatively, the coating weight may be 0.2–1000 microgram per $cm^2$.

In one preferred method of making lamps according to this invention, the desired portions of the internal surface of the envelope and the surfaces of internal components which are exposed in the finished lamp are coated either separately or after assembly with an organic solvent solution of an aluminium compound or complex capable of generating aluminium oxide, and subsequently heated to evoporate the solvent and cure the composition to form a defect-free aluminium oxide coating. It has been found valuable in the production of defect-free coatings to allow the applied liquid coating composition to drain thoroughly and thereafter to bake initially at a relatively low temperature to remove the solvent and subsequently at a controlled higher temperature to complete the formation of the protective coating. The preferred baking temperatures vary with the particular composition employed to generate the aluminium oxide, but can be determined by experiment.

One example of this technique will now be described with reference to the accompanying drawing which shows diagrammatically a tungsten-halogen lamp assembly in the course of manufacture.

As shown in the drawing, a 12 V. 55 W. tungsten-halogen lamp, of the type commonly used in projector and motor vehicle lighting applications, comprises a fused quartz envelope 1 in which is sealed a tungsten filament 2 supported on filament tails or lead-in wires 3 and is provided with an exhaust tube 4. The lamp is to be provided with an aluminium oxide barrier layer covering the inside surface of the envelope 1, the filament 2 and filament tails 3.

A liquid coating composition capable of generating the aluminium oxide is dispensed from a hypodermic syringe through the lamp exhaust tube 4 by inserting the needle of the syringe, discharging the liquid composition and then almost immediately drawing it back into the syringe, leaving only a thin layer adhering to the inside surfaces of the lamp structure. At this stage the lamp is inverted to drain, and then heated in a vacuum or suitably inert atmosphere, for example at approximately 100° C. for an hour in the case of a methanolic composition. The aluminium oxide coating is finally formed by baking at a higher temperature, for example at 500° C. in a vacuum or suitably inert atmosphere for about 5 minutes. The final bake can be effectively incorporated in subsequent lamp processing.

The initial heating cycle is chosen to substantially remove the solvent and the time, temperature and atmosphere will depend upon the solvent selected. The temperature of the subsequent bake depends on the particular formulation used, but will in general be below 1000° C.

The lamp is then processed in the normal manner for tungsten-halogen lamps. When the filament is first energised the aluminium oxide layer on the incandescent filament surface and part of the filament tail adjacent to the filament is removed, leaving a protective barrier on the envelope surface and cold parts of the filament tails or lead-in wires.

In accordance with one aspect of this invention it has been found that when such lamps are provided with a fluorine-containing fill they can be operated with less or even substantially no attack on the filament tails, the filament or the envelope surface by fluorine or fluorides. The fluorine can be added as the element, or more conveniently as $WF_6$ within the pressure range of 1 to 10 Torr, or as $NF_3$ or $SF_6$ or a solid such as $NF_4SbF_6$, $NF_4AsF_6$, $XeF_4SbF_6$, $XeF_4AsF_6$, $TeF_4SbF_5$ or $SeF_4SbF_5$. Solids may also be added in solution in suitable solvents as disclosed in the specification of our Patent No. 3,898,500.

An alternative source of fluorine is described in our copending Application Ser. No. 759,705, namely a soluble fluorocarbon polymer, which can be metered into the lamp envelope in solution in, for example, a fluorinated organic solvent.

In accordance with another aspect of this invention, cheaper or more easily obtainable or workable materials are used for the envelope or internal components of halogen cycle lamps by providing on the exposed surfaces of such parts of the structure a coating of aluminium oxide as described above.

In certain established tungsten-halogen lamps (e.g. twin filament car lamps), a molybdenum frame or wires is or are used both as lead-in conductors and as a member to carry a molybdenum (or tungsten) shield. There is some evidence to suggest that there is a limited chemical reaction between these components and the fill, and in such a case it is advantageous to coat them with a halogen- or halide-resistant layer of the aluminium oxide. However, as an alternative, the refractory metal in these components can be replaced by a less expensive and easier to work metal, such as iron or nickel, coated with the aforementioned layer.

A further possibility is to use a glass envelope coated with a halogen- or halide-resistant layer of aluminium oxide in place of the fused quartz conventionally employed for such envelopes. This may involve a direct replacement of fused quartz by a hard glass, such as borosilicate or alumino-silicate, or the use of inexpensive soda-lime silicate soft glass. In the latter case the envelope dimensions should be carefully chosen so that the hottest part is below the glass strain temperature and the coldest part is above the well-established minimum for the particular tungsten-halogen cycle to function. This also would reduce material and manufacturing costs. It should be noted that aluminosilicate glass is used for the envelope material of certain tungsten-halogen lamps but cannot be considered as a replacement for fused quartz. It will thus be apparent that individual components or all the internal surfaces within the lamp may be coated.

The following are specific examples of the practical application of the present invention and the production of tungsten-halogen lamps.

EXAMPLE 1

A liquid aluminium oxide coating composition was prepared by dissolving anhydrous aluminium chloride (3.95 g.) in methanol (396.05 g.). A tungsten filament lamp assembly was coated internally with this composition by the technique described above and the coated assembly thoroughly drained, heated at 100° C. in vacuo for one hour, and baked at 500° C. for 5 minutes also in vacuo. The lamp was subsequently filled with 3½ atm. argon and 4 Torr $WF_6$ and finished in the usual way.

The lamp was rated at 12 V. 100 W. in operation and was successfully run at a filament temperature of 3200° C. for more than 25 hours without breakdown of the coating. In contrast, similar lamps without the coating of this invention showed extremely rapid loss of fluorine due to reaction with the lamp components and had a useful life of only a few minutes.

EXAMPLE 2

Lamps were made as described in Example 1 except that 4 Torr of $SF_6$ was used instead of the $WF_6$. The lamp was equally successful.

EXAMPLE 3

Lamps were made as described in Example 1, except that the coating composition consisted of 3.5 g. cerium chloride ($CeCl_3$) dissolved in 96.5 g. methanol, any precipitate separating out being filtered off before use. The lamps were baked at 600° C. for 5 minutes in vacuo and showed similar performance.

EXAMPLES 4 TO 10

The following are further samples of coating compositions employing different metals, which may be used for the purposes of this invention:

Example 4: 6.2 g. $Ce(NO_3)_3.6H_2O$ dissolved in 93.8 g. methanol (and filtered).

Example 5: 4.4 g. $SnCl_4$, anhydrous, dissolved in 95.6 g. methanol.

Example 6: 5.9 g. $SnCl_4 .5H_2O$ dissolved in 94.1 g. methanol.

Example 7: 7.0 g. $ZrOCl_2.8H_2O$ dissolved in 93.0 g. methanol.

Example 8: 3.9 g. $Sn(NO_3)_3$ hydrate, dissolved in 96.1 g. methanol.

Example 9: 4.4 g. $YCl_3$ hydrate, dissolved in 95.6 g. methanol.

Example 10: 3.2 g. $ThCl_4$ hydrate, dissolved in 96.8 g. methanol.

The salts used were of technical grade. In the case of Example 4 some precipitate formed on standing and this was filtered off. In the other Examples no filtration was necessary.

We claim:

1. In a electrical incandescent lamp comprising an envelope of vitreous material having a gas fill containing fluorine and a tungsten filament mounted therein, the improvement comprising:

a continuous imperforate transparent coating applied directly to the internal surface of said envelope, said coating consisting essentially of aluminum oxide resistant to fluorine attack and being derived from a compound of aluminum deposited on said surface from solution, said coating having a thickness in the range from 0.001 to 1 micron.

2. A lamp according to claim 1 including internal components having surfaces exposed to said gas fill, said exposed surfaces also having a continuous imperforate coating of said aluminum oxide.

3. In an electrical incandescent lamp according to claim 1 wherein said coating has a weight which lies in the range from 0.02 to 1000 micrograms per $cm.^2$.

* * * * *